US005143682A

United States Patent [19]

Dhuyvetters

[11] Patent Number: 5,143,682

[45] Date of Patent: Sep. 1, 1992

[54] DEVICE FOR THE UNIFORM SPREADING OF COVERING MATERIAL

[75] Inventor: Robert Dhuyvetters, Zwijnaarde, Belgium

[73] Assignee: Repa International Limited, Dublin, Ireland

[21] Appl. No.: 502,268

[22] Filed: Mar. 30, 1990

[30] Foreign Application Priority Data

Mar. 30, 1989 [BE] Belgium ..... 089 00352

[51] Int. Cl.[5] ..... C21C 7/00

[52] U.S. Cl. ..... 266/216; 164/268

[58] Field of Search ..... 75/709; 266/216; 414/199; 164/55.1, 268, 417

[56] References Cited

U.S. PATENT DOCUMENTS 4,408,750 10/1983 Andersson et al. ..... 266/216

FOREIGN PATENT DOCUMENTS 59411 8/1982 European Pat. Off. .
0171220 2/1986 European Pat. Off. .
357017 8/1922 Fed. Rep. of Germany .
1376283 9/1964 France .
2613053 3/1988 France .
715050 9/1954 United Kingdom .

*Primary Examiner*—Melvyn J. Andrews
*Attorney, Agent, or Firm*—Leydig, Voit & Mayer

[57] ABSTRACT

The device (1) according to the invention achieves a homogeneous, protective and insulating covering layer on the top layer of a casting ladle containing molten steel. It comprises a fixed part from which a cover wiht scrapers (21, 22) is suspended, and a rotating part (2) fitted below the scrapers (21, 22). The rotating part (2) comprises a series of troughs (12) which are uniformly distributed around a central shaft (10). The troughs (12) have a radially widening slit in the direction away from the central shaft (10). Through the rotating movement of the rotating part (2) and the levelling action of the fixed scrapers (21, 22), the bulk material is uniformly distributed over the troughs (12) of the distribution bin. A rising and falling cover (4) makes it possible to process varying volumes of bulk material.

10 Claims, 8 Drawing Sheets

Fig. 4
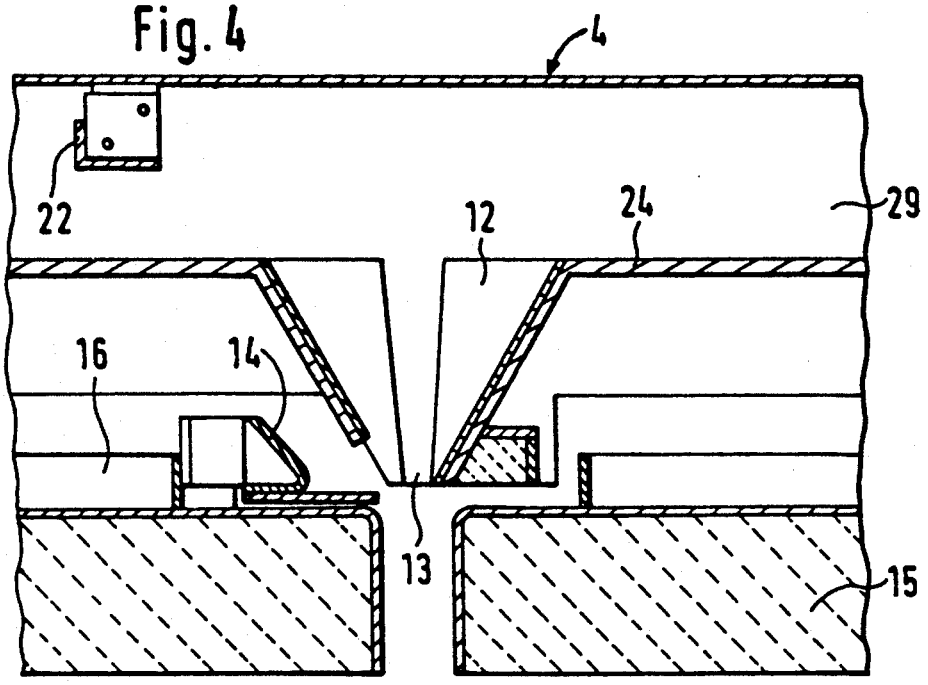
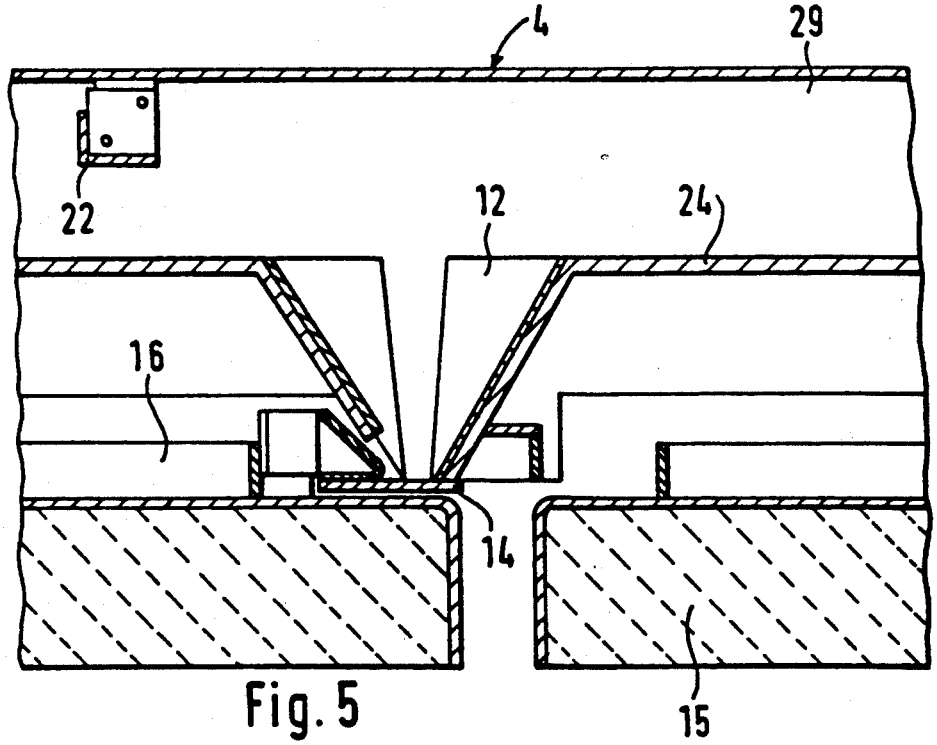
Fig. 5

DEVICE FOR THE UNIFORM SPREADING OF COVERING MATERIAL

The present invention relates to a device for the uniform spreading of a bulk material on a circular surface, in particular of a granular or powdered covering material on the top layer of a casting mould or casting ladle containing molten steel or metal, in order to achieve a homogeneous, protective and insulating covering layer.

The invention is particularly intended for preventing heat losses in casting ladles and steel casting moulds. The insulating layer also serves to prevent adverse elements in the surrounding air from combining with molten steel.

In order to avoid heat losses through radiation, it is known to place a granular covering material on the top layer of a casting mould. The material used is sawdust, glass or sodium silicate. Vermiculite is also used for volatile steel. It is an inorganic insulating material based on volcanic rock which makes it possible to reduce the losses through evaporation by 75 to 80%. It is a covering material with a very low thermal conductivity which ensures excellent heat insulation.

Recovered material can also be used, e.g. granules of spent catalysts, as described in Belgian Patent No. 900626, after calcination in order to protect steel or molten metal such as copper from further oxidation.

The pouring of granular or powdered or covering material onto the top layer of a casting ladle was hitherto carried out in a very rough fashion by means of a hoisting mechanism and a chute.

The disadvantages of too simple a process are completely inadequate accuracy in the metering of the desired quantity in order to obtain a predetermined layer thickness and also an uneven distribution of the bulk material over the whole surface to be covered.

In order to eliminate these disadvantages, the present invention proposes a device of the type described in the preamble of claim 1. Such a device makes it possible to spread a bulk material uniformly on the top layer of a casting ladle or steel casting mould, in order to achieve a homogeneous protection and insulation carpet.

The device is characterized in that it comprises at least one rotating part and one fixed part, the rotating part being a distribution bin which is suspended from a bearing-mounted drive shaft and has a bottom in which a series of troughs are recessed around the drive shaft, and the fixed part bearing a cover whose bottom side is provided with at least one scraper.

In a special embodiment of the invention, the trough-shaped bins have a triangular, pyramid-shaped, funnel-type empty space which widens in the direction away from the central shaft.

According to a special feature of the invention, the fixed frame has at least one fixed scraper which is directed radially relative to the above-mentioned central shaft.

It is advantageous to provide scrapers which are adjustable in height, so that they ensure a space of variable useful volume above the trough-shaped bins.

In a special embodiment the rotating part is equipped at the bottom with a heat shield.

The heat shield is rotatable relative to the rotating part and can undergo a slight displacement relative to the rotating part, so that the outflow openings of the trough-shaped bins are opened.

Other special features of the invention are emphasized in the accurate description of the appended drawings which show schematically, and not restrictively, a possible embodiment of the device according to the invention.

In these drawings:

FIG. 4 shows a cross-section of an outflow opening, in the open position;

FIG. 5 shows a cross-section of an outflow opening, in the closed position;

The same reference numbers in these two figures indicate identical or similar elements.

Figure 1:
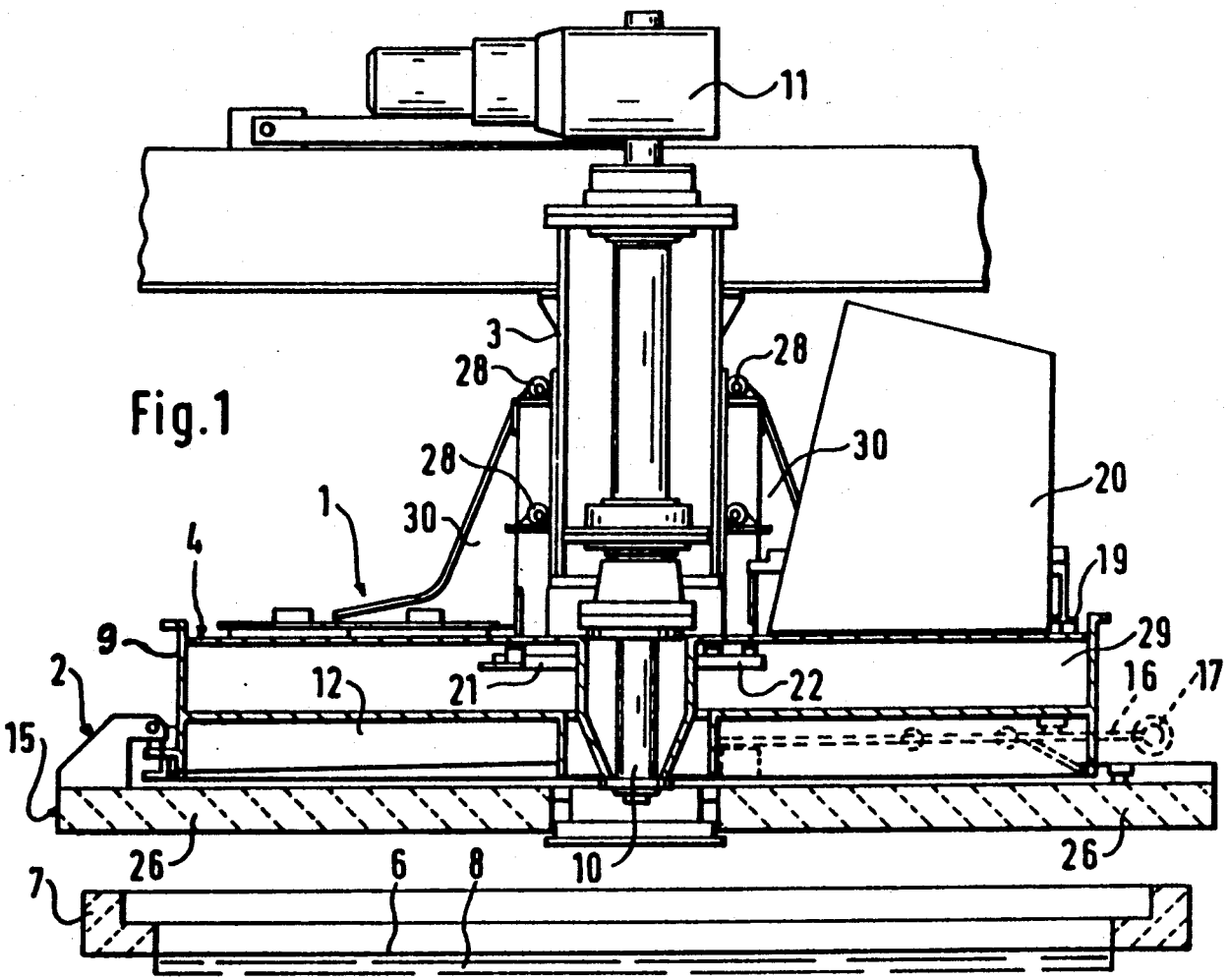
FIG. 1 shows a front view of the device according to the invention, erected above a steel casting mould.
Figure 2:
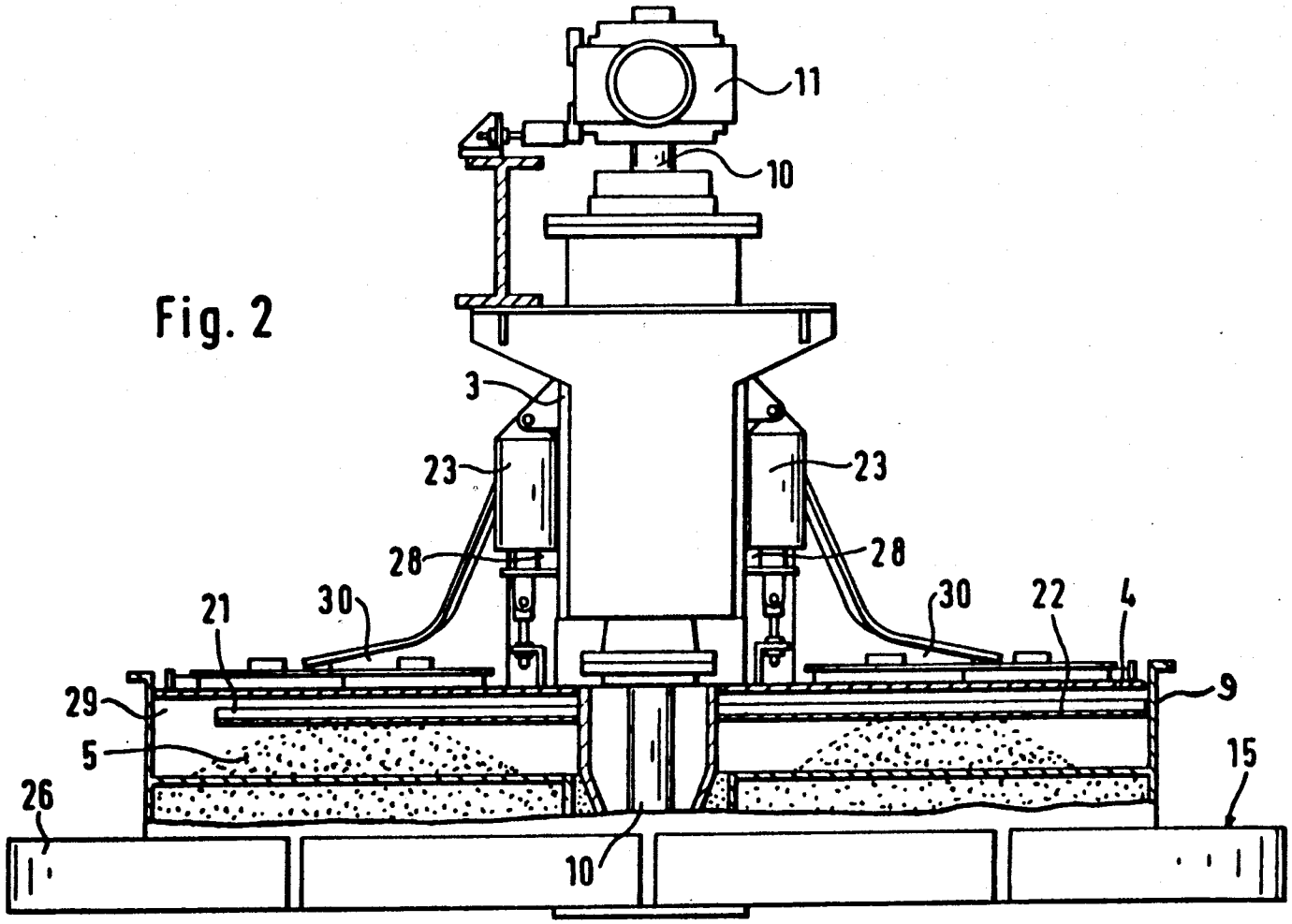
FIG. 2 shows a side view, partially in cross-section, of the device shown in FIG. 1.
Figure 3:
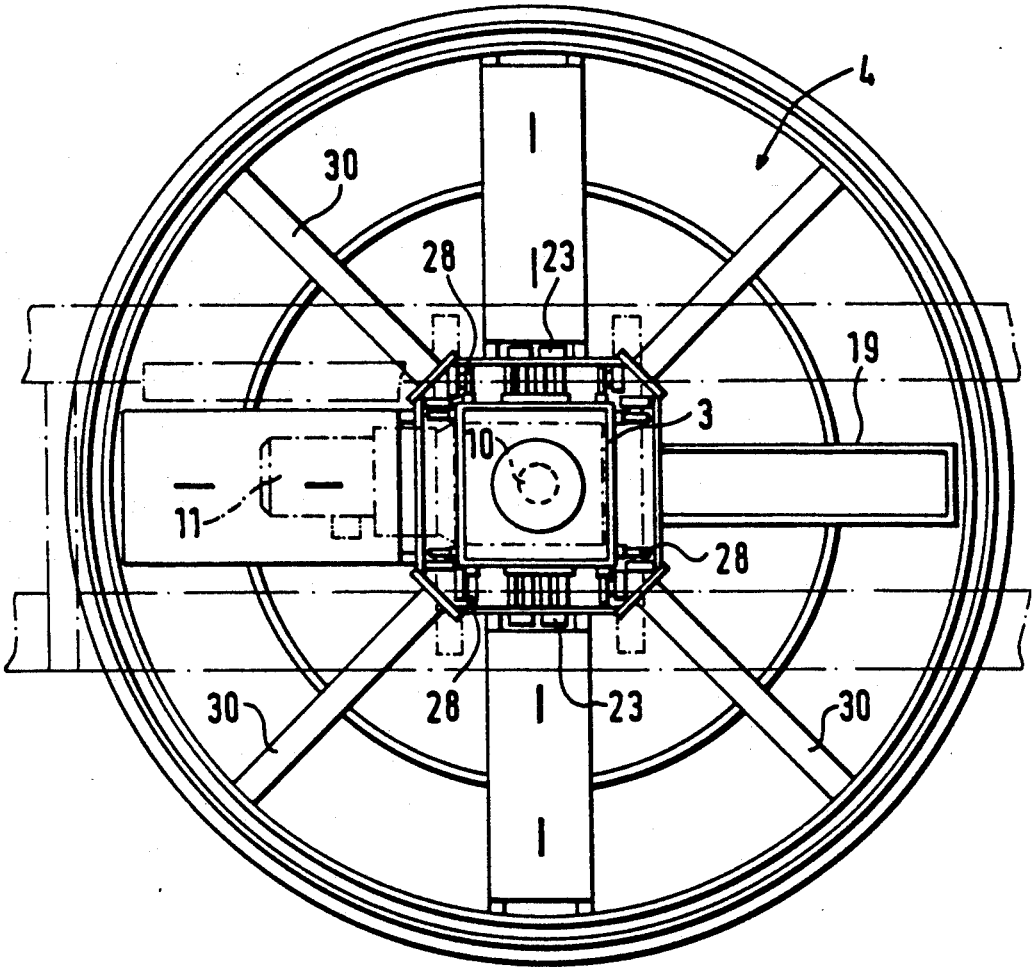
FIG. 3 shows a top view of the device shown in FIGS. 1 and 2, without heat shield.
Figure 6:
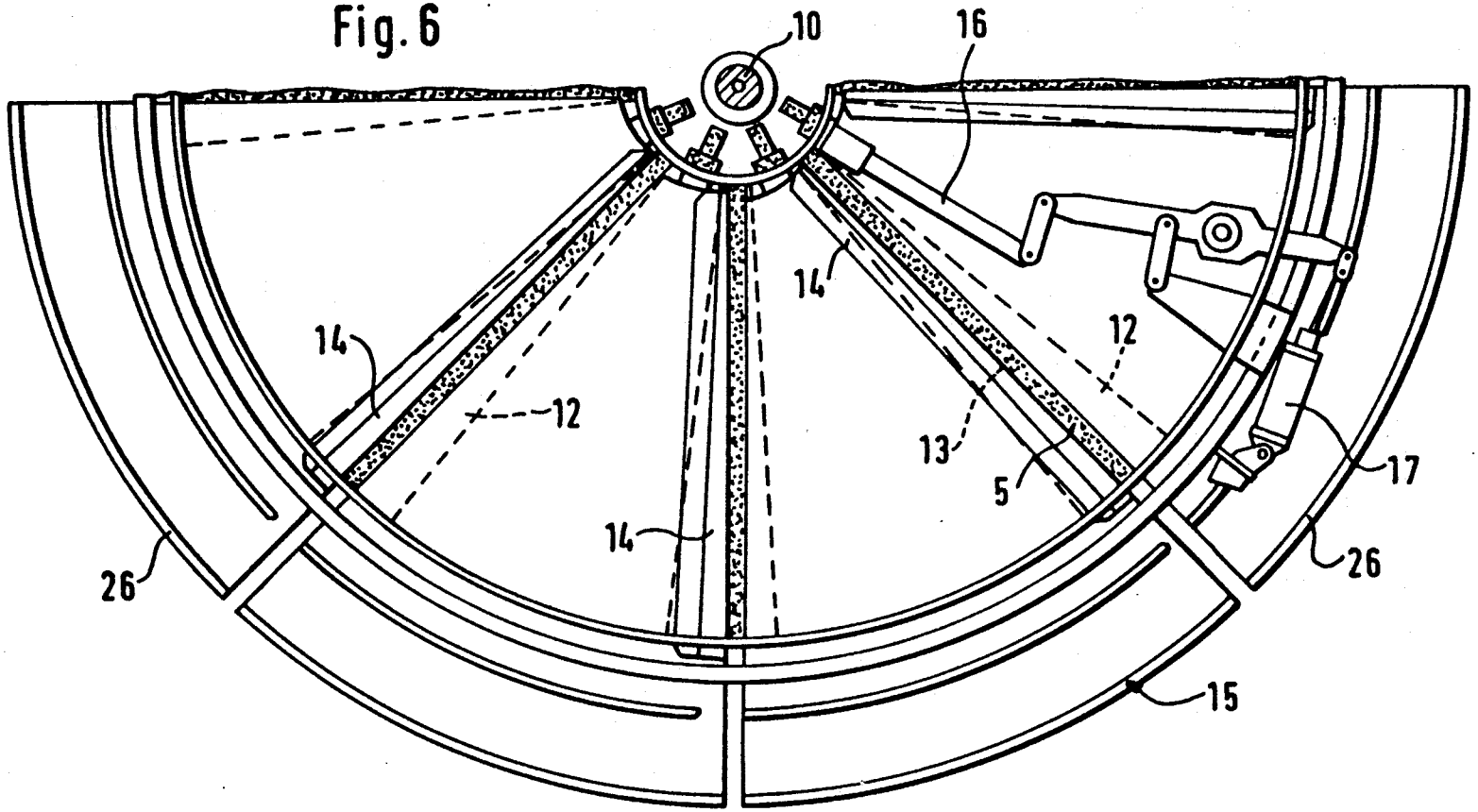
FIG. 6 shows a schematic top view of the rod mechanism operating the opening of the slides of the outflow openings.
Figure 7:
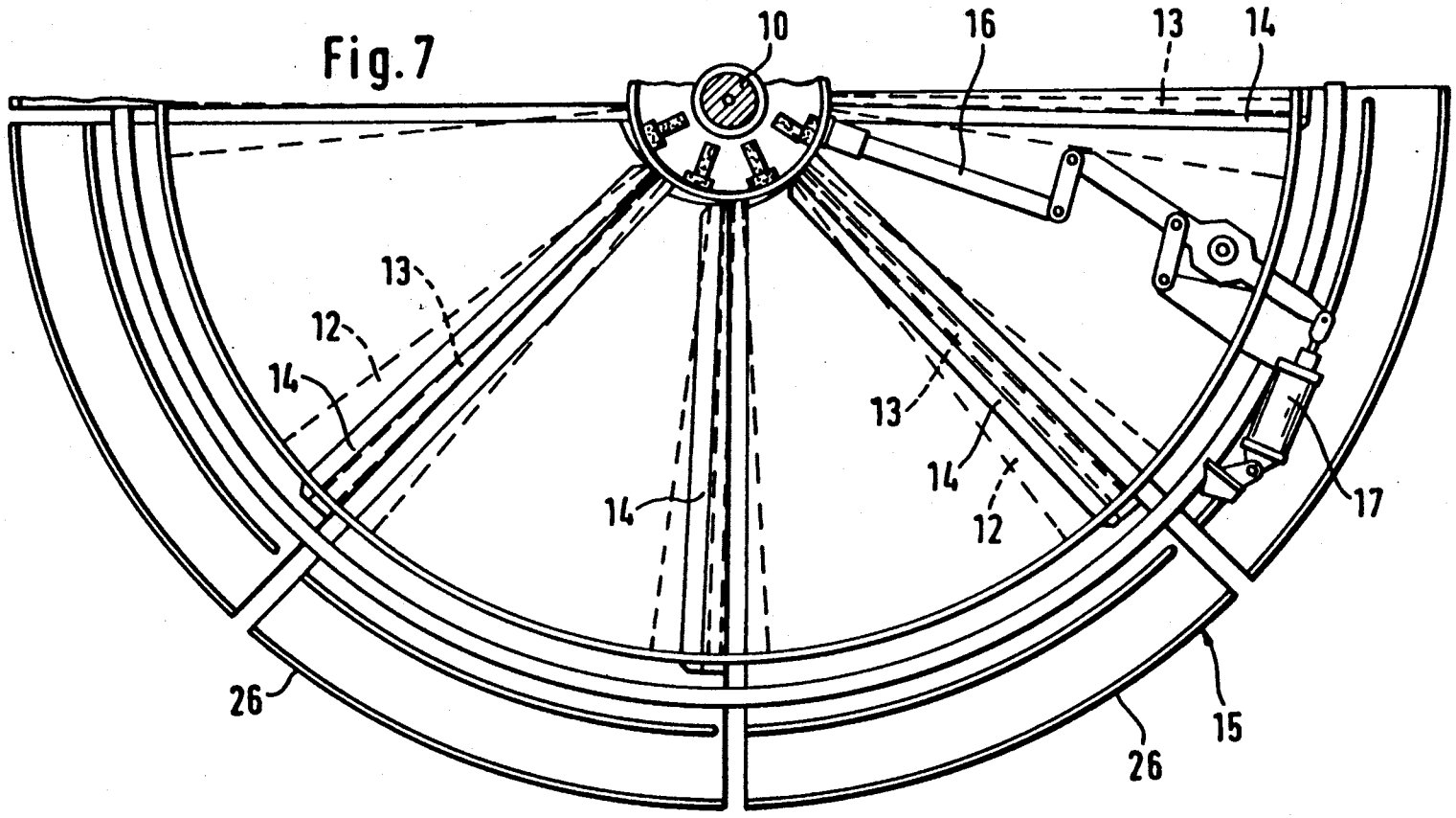
FIG. 7 shows a schematic top view of the rod mechanism operating the closing of the above-mentioned slides.

As shown in FIG. 1, the distribution system according to the invention, indicated in its entirety by reference number 1, is made up of three parts: a rotating part 2, a fixed part 3, and a rising and falling cover 4.

The distribution system 1 is intended for the uniform spreading of a bulk material on a circular surface, in particular for spreading a granular or powdered covering material 5 on the top layer 6 of a casting mould 7 containing molten steel 8 or metal. Its object is to achieve a homogeneous, protective and insulating covering layer which would prevent adverse elements in the surrounding air from combining with molten steel along the top layer 6 of the steel bath.

The rotating part 2 comprises a round distribution bin 9 suspended from a bearing-mounted drive shaft 10, driven by a motor reductor 11 which is located on the top of the distribution system. The complete distribution bin 9 can rotate freely through 360°.

Recessed in the bottom of the round distribution bin 9 are a series of troughs 12 which are dimensioned in such a way that they can contain the minimum volume of material to be poured. In a special embodiment shown in FIG. 1 the number of troughs is eight.

The troughs 12 narrow towards the centre point of the distribution bin 4, and at the bottom the troughs 12 are open over the entire length. This opening serves as the outflow opening 13 for pouring the covering material 5 onto the steel bath. The outflow openings 13 are shut off at the bottom by a slide 14. The slide 14 is fitted on top of heat shields 15. The eight heat shields 15 protect the distribution bin 9 from the radiating heat and leave only a slit open as outflow opening 13. The shut-off slides 14 with the heat shields 15 are operated by a rod mechanism 16 and compressed air cylinder 17 which are fitted on the distribution bin 9, so that the opening angle relative to the centre is greater for the part closest to the centre and smaller for the part furthest from the centre. FIG. 4 shows the outflow openings 13 in the open position.

In this way the coarse granular materials flow simultaneously out along the outflow openings 13 over the entire length of the trough 12. FIG. 5 shows the same outflow openings 13 in the closed position.

The fixed part 3 is in the form of a welded tubular structure It contains a bearing mounting of the drive shaft 10 and suspension points on a structure. The motor reductor 11, which ensures the rotary movement of the distribution bin 9, controls up to the fixed part 3. Vertical guides 28 are fitted in pairs perpendicular to each other on the corners of the tubular structure for the rising and falling part 4.

The rising and falling cover 4 covers the distribution bin 9.

It comprises inspection hatches 27, a flange 19 for the connection of a down pipe 20 fitted below a stock silo (not shown) in which the bulk material is stored, and also stiffeners 30 and bearings for the rotating part 2. The bulk material is unloaded into the rotating distribution bin 9 by means of the fixed down pipe 20. At the bottom of the cover 9, scrapers 21, 22 are fitted for spreading the aggregates emptied into the distribution bin 9 uniformly over the surface of the distribution bin 9.

In order to permit the processing of a varying volume 29 from minimum to maximum quantity of aggregates, for the purpose of obtaining the desired layer thickness of covering material on the top layer 6 of the steel casting mould 7, the rising and falling cover 4 is movable in height. The rising and falling cover 4 is suspended from two pneumatic cylinders 23.

Once the aggregates have been emptied into the rotating distribution bin 9, the two cylinders 23 are vented, and the cover 9 falls slowly onto the product.

Figure 9:
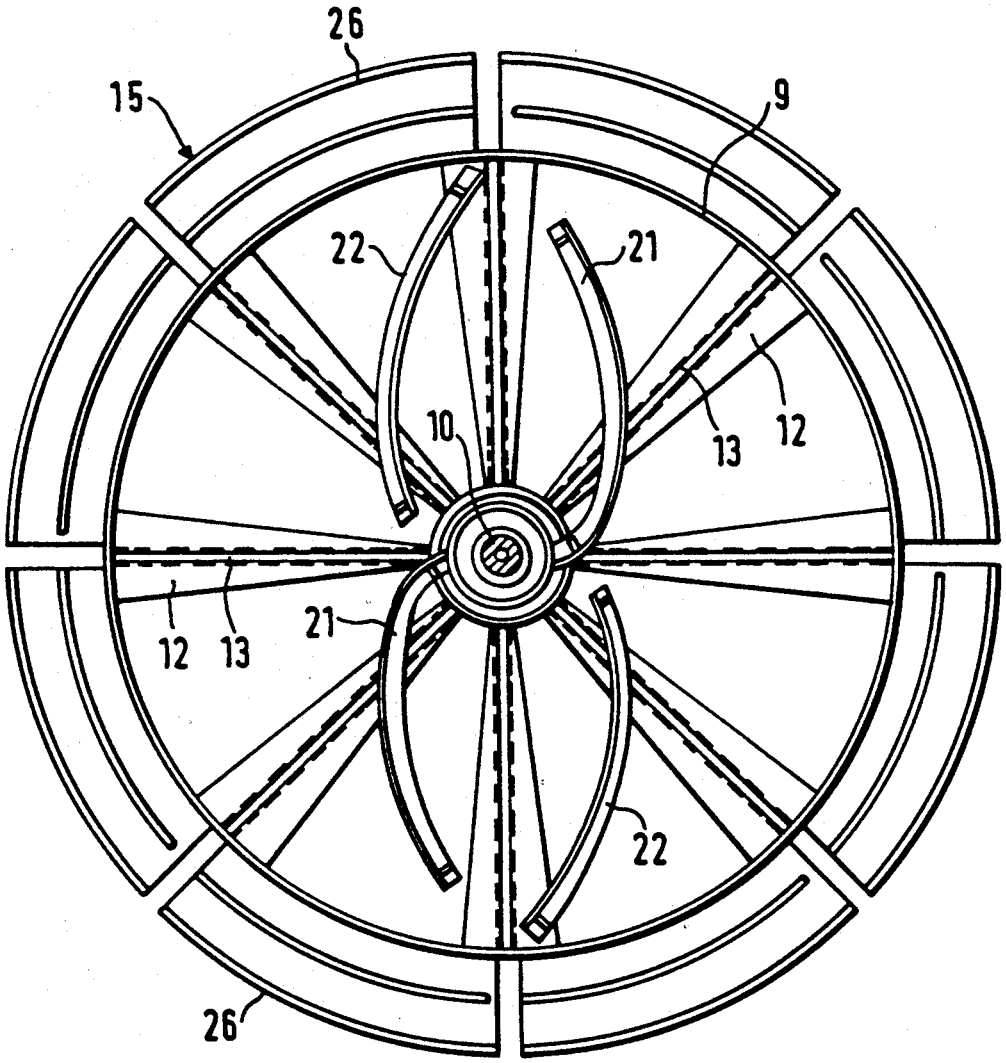
FIG. 9 shows a top view of the rising and falling cover, provided with scrapers.

Slide faces 24 are fitted so that the cover 4 remains sliding above the aggregates, while the scrapers 21, 22 work away the unevennesses and ensure a uniform distribution. The scrapers 21, 22 are divided per successive pair. The first scraper 21 is designed in such a way that the material is beaten outwards and is subsequently brought back in again by the following second scraper 22, so that in the meantime the troughs 12 are filled (FIG. 9). The scraping face of the scrapers 21, 22 is coated with 8-mm semi-wanax ®.

Fitted at the bottom of the rotating part 2, in the direction of the arrow X, is a heat shield 15 which rotates with said part.

It can make a slight shift relative to the rotating part 2, so that the outflow openings 13 are opened.

Fitted at the bottom of the heat shield 15 is an insulation blanket 26 made of ceramic fibre (kerlane), 200 mm thick. The service temperature lies at approx. 1450° C., while the temperature on the shield is approximately 120° C. The shut-off slides 14 are fixed to the heat shield and the outflow opening 13 is made through-running and slanting until past the insulation. This opening 13 opens and closes with the shut-off slides. The shut-off slides 14 are made of INOX AISI 321 stainless steel, 5 mm thick.

The covering material selected is a heatproof bulk material with very low thermal conductivity which ensures good heat insulation, e.g. vermiculite.

During the rotation the heat shield 15 is rotated in such a way that the outflow openings 13 are opened.

If the shut-off slides are opened slowly during the rotation of the distribution bin 9, the rising and falling part drops together with the material to be distributed. The bulk material falls onto the steel bath and forms a layered carpet. During the outflow of the material, the stationary scrapers 21, 22 already beat the product lying on flat parts in the troughs 12.

Figure 8:
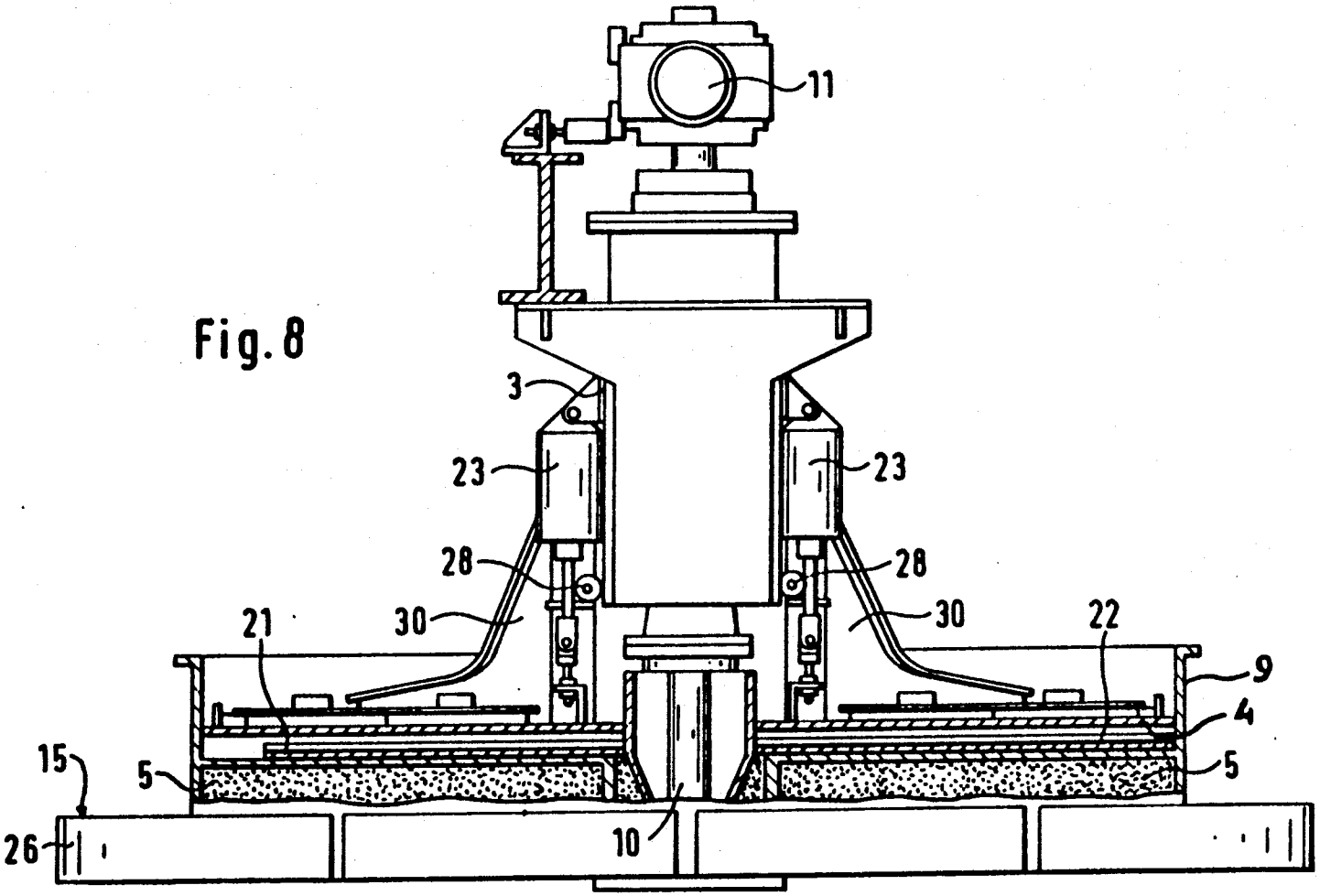
FIG. 8 shows a side view, similar to that of FIG. 2, of the device according to the invention, with increased useful volumes of the trough-shaped bins.

When the rising and falling cover 4 reaches its bottom position, shown in FIG. 8, the scrapers 21, 22 scrape the flat parts of the rotating part 2 and push this product into the troughs 12, until the distribution bin 9 is emptied. At this point a limit switch is actuated.

The limit switch commands the cylinders 23 to take the rising and falling part to its top position. After some time, all the material has then gone from the distribution bin 9 and is uniformly distributed on the top layer of the steel bath.

I claim:

1. An apparatus for uniformly spreading granular or powdered material over a casting mold containing molten steel or metal, which spreading apparatus comprises a rotating assembly and a fixed assembly, wherein:

(a) said rotating assembly comprises a drive shaft and suspended therefrom a generally cylindrical distribution bin adapted to receive said granular or powdered material;

(b) said distribution bin is provided with one or more recessed troughs extending radially of said distribution bin from about the center portion thereof;

(c) said troughs comprise outflow openings through which material may be delivered from the bin;

(d) said fixed assembly comprises a cover for said distribution bin and located above said bin; and (e) said cover is provided on its underside with at least one scraper.

2. The spreading apparatus of claim 1, wherein said troughs taper upon progressing downwardly and wherein said troughs flare upon progressing outwardly from the center portion of the distribution bin.

3. The spreading apparatus of claim 1, wherein said cover may be adjusted in height relative to said distribution bin.

4. The spreading apparatus of claim 1, wherein said cover is provided with a first series of scrapers which extend from a point near the center portion of said cover in a counterclockwise arc to a point at a distance from the outer edge of said cover and a second series of scrapers which extend from a point near the outer edge of said cover in a clockwise arc to a point at a distance from the center portion of said cover.

5. The spreading apparatus of claim 1, wherein said outflow openings extend the length of said troughs.

6. The spreading apparatus of claim 5, wherein each of said outflow openings widens upon progressing radially outwardly.

7. The spreading apparatus of claim 5, wherein the rotating assembly includes a heat shield below the bottom of said distribution bin.

8. The spreading apparatus of claim 7, wherein said heat shield is rotatable relative to said rotating assembly from a first position in which said heat shield restricts the flow of material through said outflow openings to a second position in which the flow of material through the outflow openings is not restricted.

9. The spreading apparatus of claim 1, further including a motor bracket having vertical guides, said cover being slidingly mounted along said vertical guides.

10. The spreading apparatus of claim 7, wherein said rotating assembly comprises shut-off slides, and a rod mechanism and compressed air cylinder for operating said slides.

* * * * *